United States Patent [19]

Haack et al.

[11] Patent Number: 4,905,556

[45] Date of Patent: Mar. 6, 1990

[54] BLANKING PRESS

[75] Inventors: Johannes Haack; Hans Wymann, both of Lyss, Switzerland

[73] Assignee: Feintool International Holding, Lyss, Switzerland

[21] Appl. No.: 800,291

[22] Filed: Nov. 21, 1985

[30] Foreign Application Priority Data

Nov. 28, 1984 [CH] Switzerland ..... 5683/84

[51] Int. Cl.[4] ..... B21D 37/08; B21D 51/44

[52] U.S. Cl. ..... 83/639.5; 83/137; 83/685; 72/335

[58] Field of Search ..... 83/639, 137, 679, 684, 83/685, 682, 687; 72/333, 335

[56] References Cited

FOREIGN PATENT DOCUMENTS 3227696 2/1984 Fed. Rep. of Germany .
58-65526 4/1983 Japan .
641698 3/1984 Switzerland .

OTHER PUBLICATIONS

Haack et al., *Feinschneiden,* 2nd ed.; Feintool AG, Lyss, Switzerland, (1977), pp. 80–87.

*Primary Examiner*—Donald R. Schran
*Attorney, Agent, or Firm*—Bachman & LaPointe

[57] ABSTRACT

A precision blanking tool mounted in a press, which may be a transfer press, comprises an upper part with an upper tool support and a lower part with a lower tool support. One hydraulic unit is accommodated in the upper part of the precision blanking tool and another in the lower part. The upper hydraulic unit is inserted with the upper tool support in an interchangeable frame and the lower hydraulic unit with the lower tool support in another frame. The hydraulic units are controlled with pressurized oil by drive means forming a separate unit.

7 Claims, 7 Drawing Sheets

BLANKING PRESS

Figure 1:
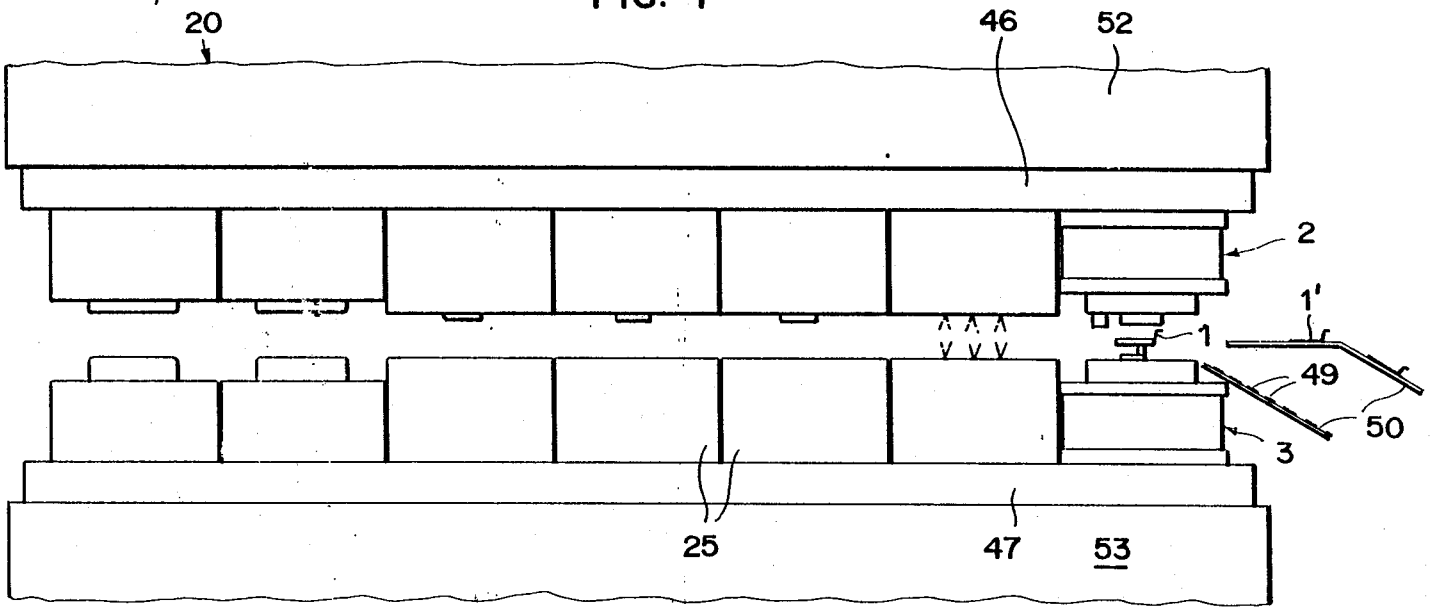

This invention relates to the machining of metal parts, and more particularly to a press for the machining of sheet-metal workpieces or of cast or forged blanks, of the type having at least two stages of operation, with each of which a tool is associated, and a device for automatically conveying the workpieces.

Finished stamped metal parts are often required to have in part an absolutely smooth cut surface at their operational locations. This also applies to stampings or blanks having bends or shoulders and to shaped cup- or dish-like parts. in order to obtain such an absolutely smooth cut surface on such blanks, it is customary to finish them, subsequent to the press-working operations, by means of a cutting operation such as turning, milling, or broaching. It is also possible, however, to produce the required absolutely smooth surfaces on such blanks non-cuttingly in a precision blanking press.

However, a prior art method of this kind for producing an absolutely smooth cut surface on stamped metal parts is disadvantageous in the sense that the finished blanks must be placed for further machining, in a second stage, in a fabricating machine designed to produce the absolutely smooth cut surface on the blanks. The result is a loss of time and an increase in manufacturing costs.

The precision blanking operation and the related precision blanking tools are described in the book entitled *Feinschneiden,* by J. Haack and F. Birzer, published by Hallwag-Verlag, Bern, 1977.

German Disclosed Application (DOS) No. 3,227,696 describes a compound progressive die used in high-speed presses. Such a tool comprises a plurality of machining stations by which a punching strip, conveyed by the tool, is machined. These machining stations are cutting, bending, elbowing, crimping, and turning stations which are sequentially accommodated in the tool.

Swiss Patent No. 641,698 further discloses a press having a progressive die, the eight stations of which carry out the shaping of the workpiece step by step. Here, the workpieces are conveyed by a device having rods provided with elastic grippers and driven in the conveying direction. By means of these rods, shaped blanks which have been formed out of the plane of the sheet metal can be conveyed rapidly.

Although the two aforementioned presses yield a finished stamped part per ram stroke at a rapid rate, this part must be further machined as described above if it is additionally to be provided in part at its operational locations with an absolutely smooth cut surface.

In Japanese Patent No. 58-65526, a press having a single tool is described. In the tool, a multistage machining of workpieces takes place in one operating stroke. There is a hydraulic unit in the upper part of the press and one in the lower part. One of the machining stages may take the form of a precision blanking stage.

However, the single-tool design cannot be applied to a transfer press, for instance.

It is an object of this invention to provide an improved blanking press in which precision blanking operations are combined with the conventional operations of stamping and/or extrusion technology in a single fabricating machine.

A further object of this invention is to provide a blanking press by means of which complicated blanks with absolutely smooth cut surfaces can be produced quickly and economically.

To this end, in the press according to the present invention, of the type initally mentioned, at least one of the stages of operation is formed by a precision blanking tool embedded at any desired stage position, in the upper and lower parts of which tool two hydraulic units are respectively mounted as the superstructure and substructure, respectively, of the tool support, which hydraulic units are inserted with the associated tool supports in an upper and a lower interchangeable frame, respectively, and are controllable by a drive means.

The upper interchangeable frame of the precision blanking tool may advantageously include a cover plate and an upper fixing plate, and the lower frame a base plate and a lower fixing plate, the drive means forming a unit separate from the interchangeable frames.

Figures 5A, 5B, 5C, 5D, 5E, 5F, 5G:
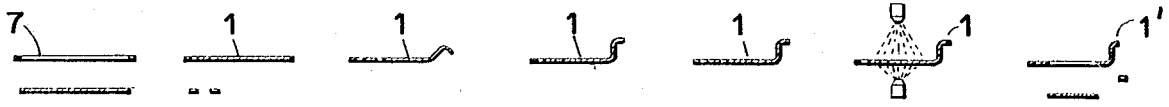
Figure 2:
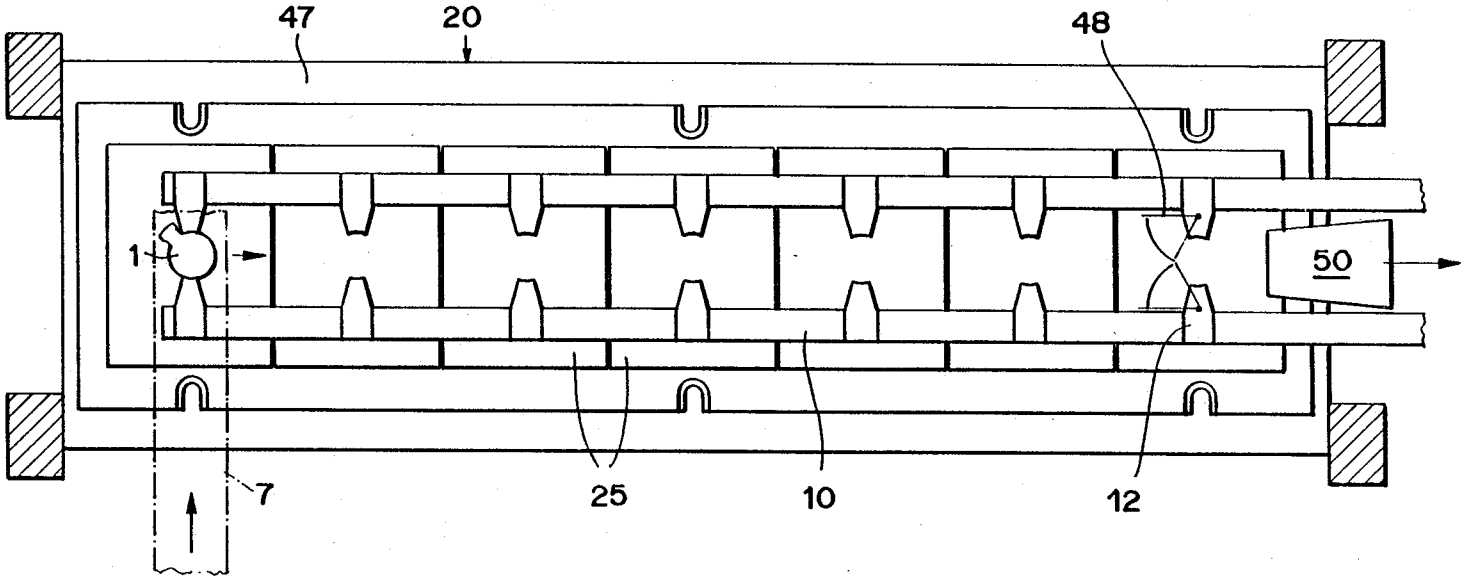
Figure 3:
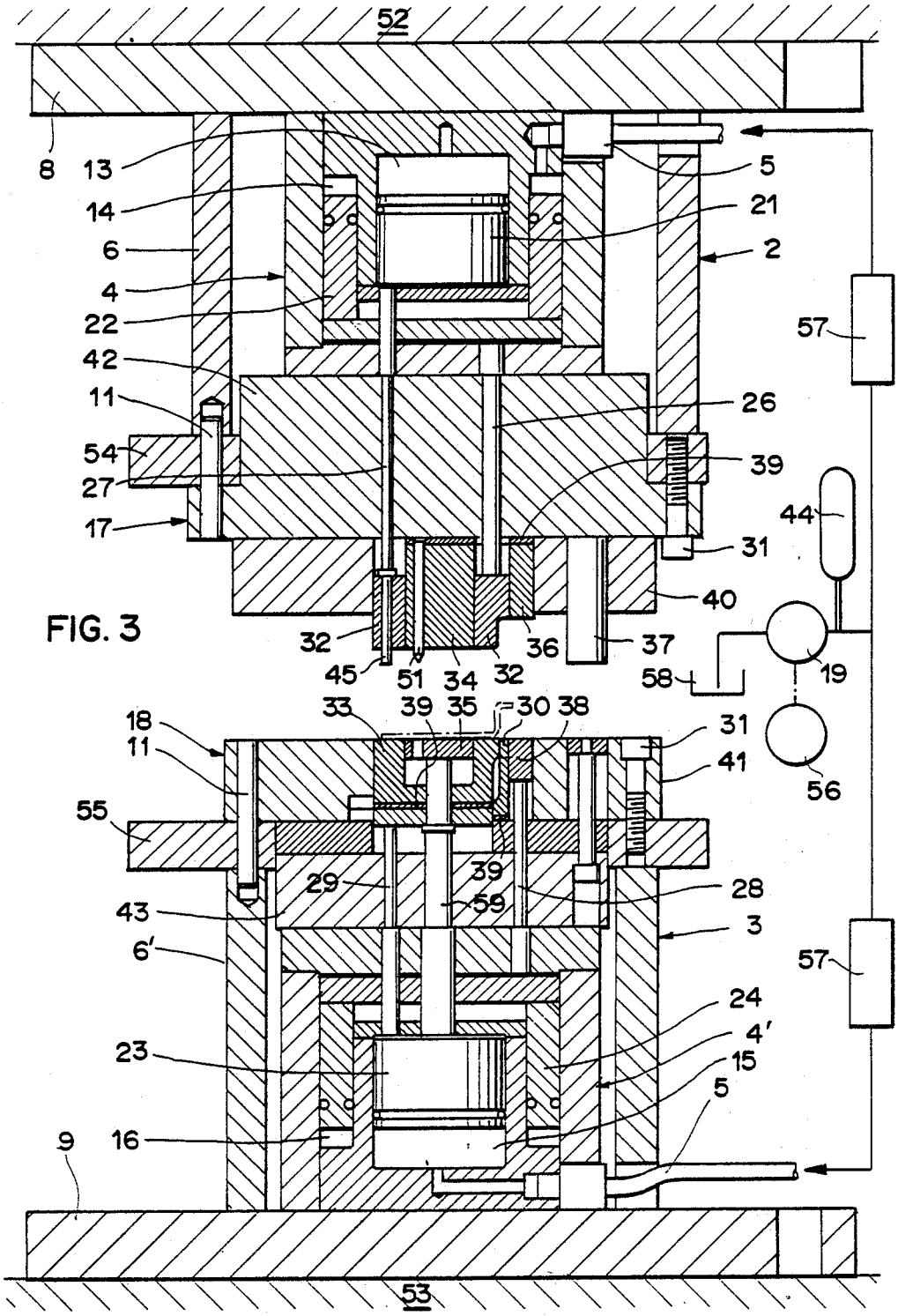
Figure 4:
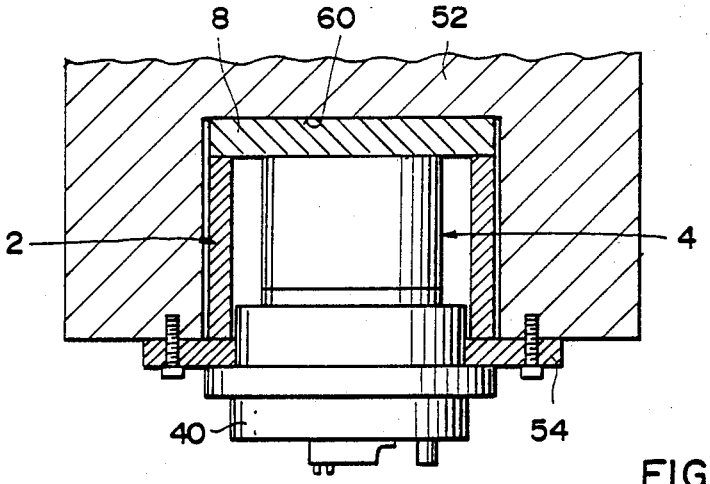
Figure 6:
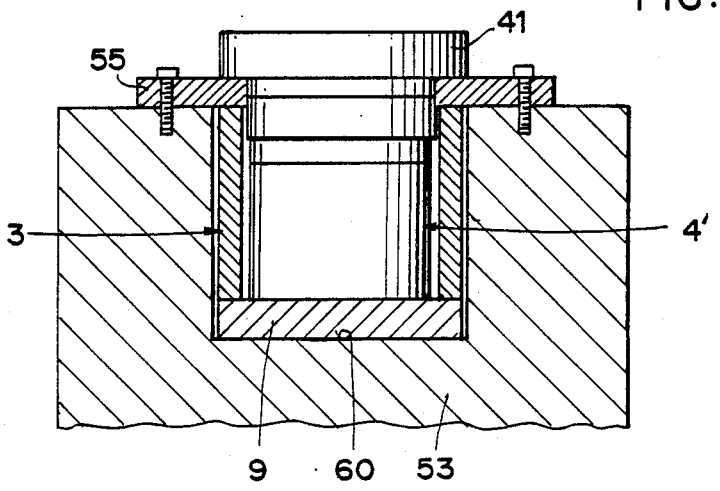
Figure 6:
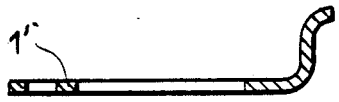
Figure 7:
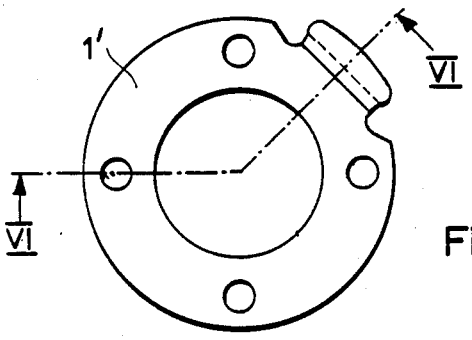
Figure 9:
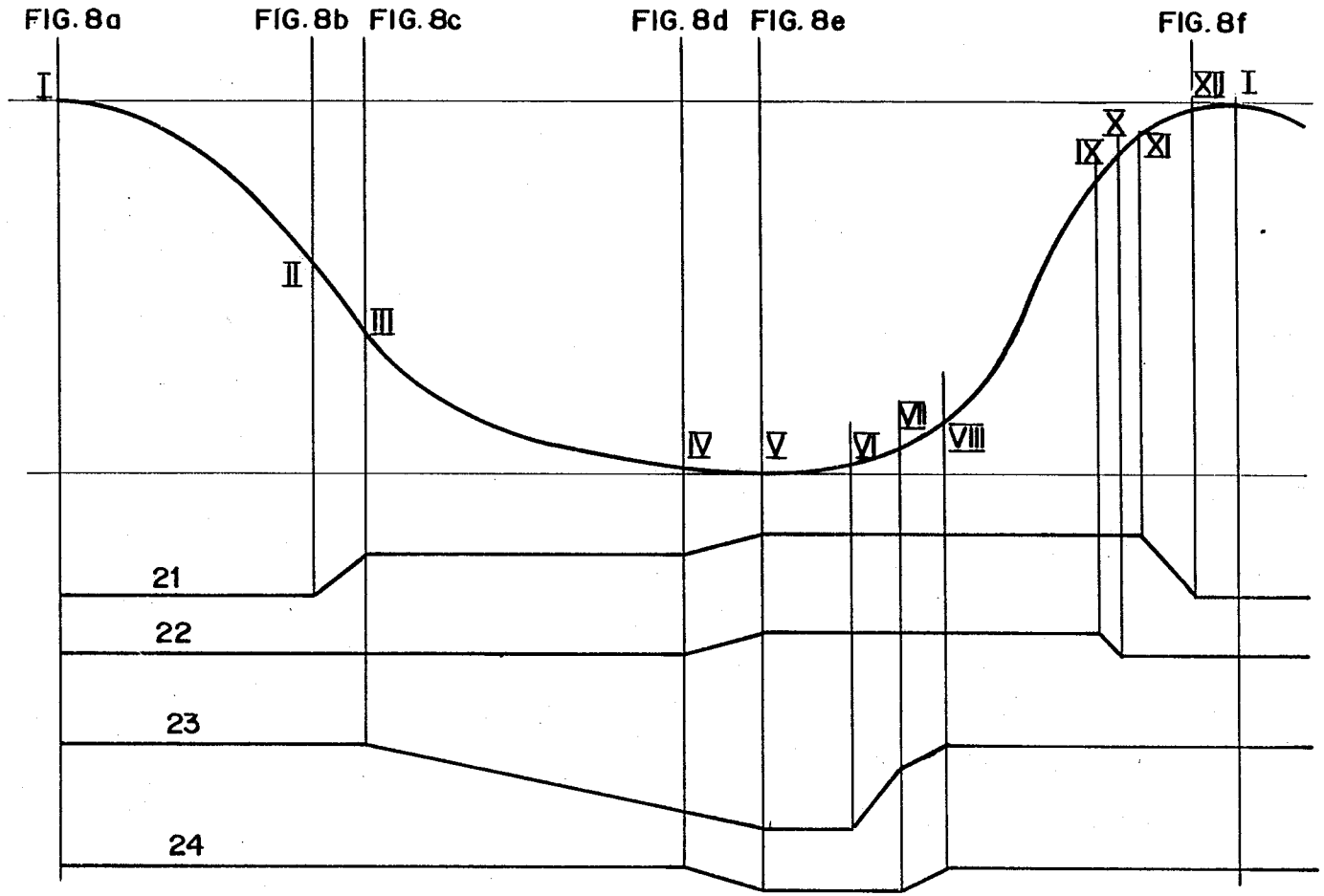

A preferred embodiment of the invention will now be described in detail with reference to the accompanying drawings, in which:

FIG. 1 is a partial diagrammatic side elevation of a transfer press fitted with the precision blanking tool of FIG. 3, FIG. 2 is a diagrammatic top plan view, partially in section, of the transfer press of FIG. 1, FIG. 3 is a section through a precision blanking tool, the hydraulic units of which are each inserted with the associated tool supports in an interchangeable frame, FIG. 4 is a diagrammatic sectional view of the precision blanking tool of FIG. 3 mounted in a precision blanking press, FIGS. 5A to 5G are sectional views of a workpiece illustrating individual machining operations in the transfer press of FIGS. 1 and 2, FIG. 6 is a section through a blank taken on the line VI—VI of FIG. 7, FIG. 7 is a plane view of a workpiece, FIGS. 8*a* to 8*f* are sectional views of a workpiece illustrating individual precision blanking operations in the precision blanking tool of FIG. 3 mounted in the seventh stage of operation in the transfer press of FIGS. 1 and 2, and FIG. 9 is a graph showing the shapes of the curves of the ram and piston movements in a transfer press including the precision blanking tool according to FIG. 3.

The precision blanking tool according to FIG. 3 consists of an upper part 2 and a lower part 3. Upper part 2 comprises a hydraulic unit 4 secured at the top to a cover plate 8 and connected at the bottom to an upper tool support 17 as the superstructure thereof. Hydraulic unit 4 and upper tool support 17 are inserted with cover plate 8 in an interchangeable frame 6. By means of fixing screws 31, the upper block 42 of upper tool support 17 is secured to interchangeable frame 6. In a similar manner, lower part 3 comprises a hydraulic unit 4' secured at the bottom to a base plate 9 and connected at the top to a lower tool support 18 as the substructure thereof. Hydraulic unit 4' and lower tool support 18 are inserted with base plate 9 in an interchangeable frame 6'. By means of fixing screws 31, cutting plate 41 of lower tool support 18 is secured to interchangeable frame 6'.

Also shown diagrammatically in FIG. 3 is a plant for supplying hydraulic units 4, 4' with pressurized oil, forming a unit separate from frames 6, 6'. This plant consists of a motor 56, a pump 19, and a tank 44. A liquid receptacle 58 is also provided. Each hydraulic unit 4, 4' has two piston cylinders. In hydraulic unit 4, these are cylinders 13, 14 and pistons 21, 22, whereas in hydraulic unit 4', they are cylinders 15, 16 and pistons 23, 24. The pressurized oil is delivered to hydraulic units 4, 4' via valves 57 and connections 5. Piston cylinders 13–16 act independently of one another, and the pressures effective therein can be individually adjusted, as well as individually switched on and off, via valves 57.

The hydraulic pressures produced in hydraulic units 4, 4' assume clamping, stripping, and ejection functions. However, they are also used for holding the workpiece in position or at conveyance level. Piston 22 is thus operatively connected to a thrust bolt 26 for a counterpunch 32, piston 21 to a thrust bolt 27 for stripper 45, piston 24 to a thrust bolt 28 for ejector 38, and piston 23 to a thrust bolt 29 for expeller 35 and lower counterpunch 33. Reference numeral 40 designates a guide plate in upper tool support 17, numeral 34 an inside forming punch, and numeral 36 a pre-cutting punch. In lower tool support 18, reference numeral 30 designates an insert in cutting plate 41 and numeral 43 a lower support. In both the upper and lower tool supports, spacer plates 39 are provided for the exact adjustment of inside forming punch 34 and pre-cutting punch 36, of lower counterpunch 33, and of insert 30 for the purpose of adjustment after the precision cutting. Latch bolts 37 secure the position of guide plate 40 relative to lower tool support 18. Reference numerals 11 designate centering pins for tool supports 17, 18, numerals 51 blank-position locators, and numerals 59 expeller bolts.

Workpieces 1 having a shape formed out of the plane of a sheet of metal can be advantageously produced on a transfer press 20 as shown in FIGS. 1 and 2. In this press, the precision blanking tool of FIG. 3 is mounted in the seventh and last operating stage. Together with the other shaping tools 25, the precision blanking tool of FIG. 3 represents a set of tools. In the last precision blanking stage, an absolutely smooth cut surface at the operational locations of blank 1 is achieved. Workpiece 1 is finished to a precision blanked part 1' in seven operations.

A blank is cut by a blanking die from a strip of material 7 (FIG. 5A) fed to transfer press 20 having a ram 52 and a table 53. In the second operation according to FIG. 5B, workpiece 1 is trimmed (change of raw edge in the bending zone). In the third and fourth stages (FIGS. 5C and 5D), the workpiece is bent, in the fifth operation the angle and height of the workpiece are set (FIG. 5E). In the sixth stage (FIG. 5F), lubricating oil is sprayed on workpiece 1 for the precision blanking operation, and in the seventh stage (FIG. 5G), the precision blanking operation is carried out by means of the built-in precision blanking tool according to FIG. 3.

The built-in precision blanking tool can take over the following operations: perforating, pre-cutting, trimming, bevel cutting, and cutting out. In this method of finishing in a transfer press, the blank or workpiece 1 is conveyed to the individual stages of operation by means of rod grippers 10 having gripper tongs 12. The scrap from the normal blanking stages falls through an opening (not shown) in table 53. The scrap 49 produced by the precision blanking is carried off over removal plates 50 by means of swivel arms 48 fastened to gripper tongs 12.

As may further be seen from FIGS. 1 and 2, all of the tools 25 (cutting and shaping tools) and the precision blanking tool are assembled on a single, common, upper mounting plate 46 and a single, common, lower mounting plate 47. This ensures a quick change of the entire set of tools in transfer press 20. When a stage of operation is omitted, only the tool associated therewith need be removed and readjusted. The precision blanking stage may be inserted at any desired stage position as required by the optimum solution for the workpiece. Moreover, several precision blanking tools as described above may be inserted in various stages of operation of the transfer press. This is made possible in that the above-described precision blanking tool bears the additional hydraulic system necessary for precision blanking.

The precision blanked part 1' shown in FIGS. 6 and 7 was fabricated in a transfer press by means of the built-in precision blanking tool of FIG. 3; the corresponding precision blanking operations are shown in FIGS. 8*a*–8*f*, which figure numbers are likewise entered in FIG. 9.

Figure 8F:
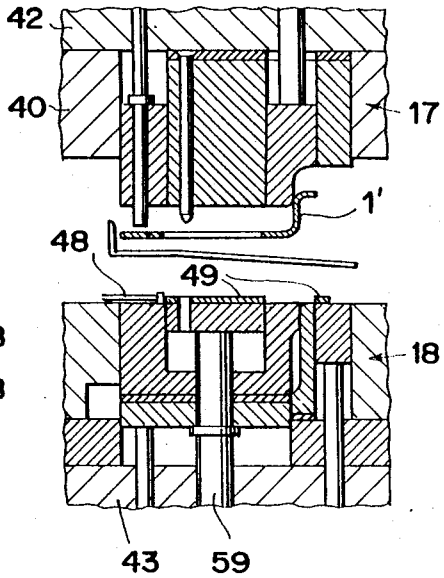
Figure 8E:
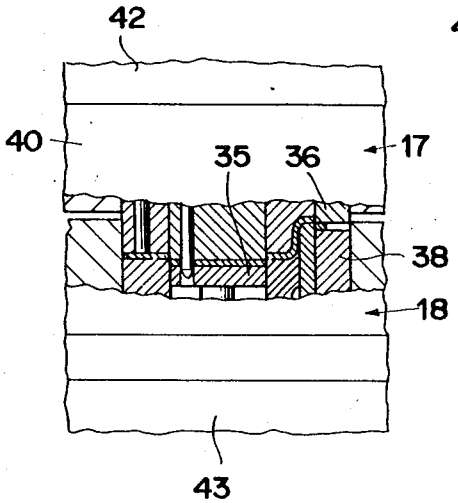
Figure 8D:
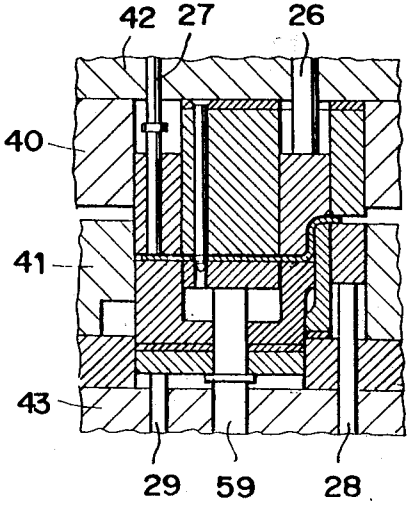
Figure 8C:
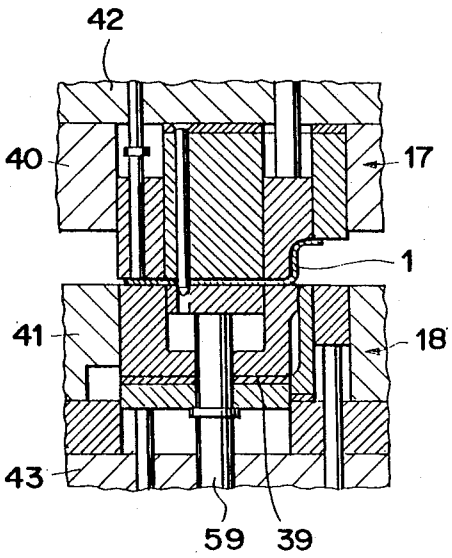
Figure 8B:
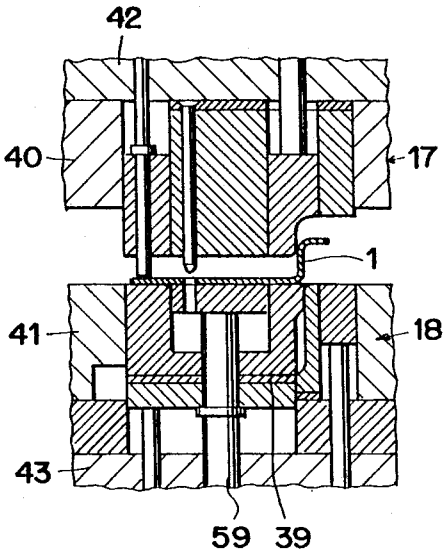
Figure 8A:
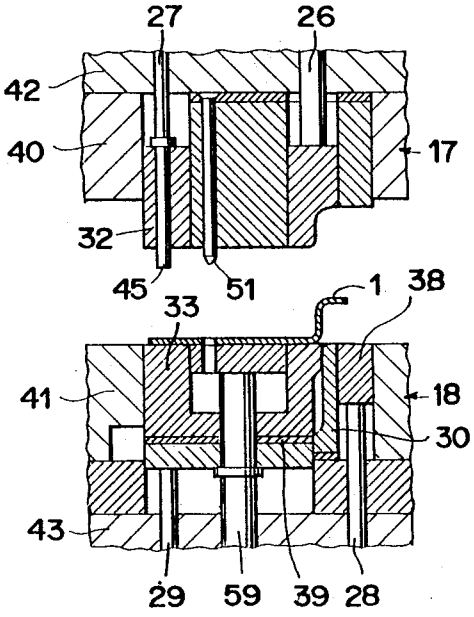

In the position shown in FIG. 8*a*, the precision blanking tool is open. The bent workpiece 1 lies upon the lower tool support 18. The ram (not shown) of the transfer press is at top dead center—position I. In the position shown in FIG. 8*b*, the ram is coming down. Strippers 45 touch workpiece 1; piston 21 in cylinder 13 is forced upward. The ram is now in position II. In the position depicted in FIG. 8*c*, the entire upper tool support 17 is in contact with workpiece 1, which is clamped between the upper and lower tool supports 17 and 18. Locator 51 is inserted in the corresponding hole in workpiece 1 and in expeller 35 of lower tool support 18 and centers the position of the part. The ram is in position III. In the position shown in FIG. 8*d*, the ram comes down farther, forcing piston 23 downward. Now the bend in workpiece 1 is also clamped between upper and lower tool supports 17 and 18. The ram is in position IV. Next, the actual cutting operation begins, with pistons 21 and 22 being forced upward and pistons 23 and 24 downward. At the end of this operation, the ram is at bottom dead center—position V, which position it is seen to occupy in FIG. 8*e*. The pressing effect of pistons 21–24 is switched off; the ram returns upward. In position VI of the ram, the pressure of piston 23 is switched on again, whereby blank 1 is expelled upward. In position VII of the ram, piston 23 pushes the inside shaping scrap out, and the outside shaping scrap is stripped off by the pressure of piston 24. This operation is concluded in position VIII. The ram continues to withdraw upward, with workpiece 1 hanging on upper tool support 17. In position IX, piston 22 receives pressure, and the expulsion of precision-blanked part 1' (stripping) begins, this operation taking place in position X. However, blank 1' is still hanging above from the bend. In position XI, piston 21 receives pressure and starts to strip precision blank 1' completely out of the bend of upper tool support 17. This operation is terminated in position XII, and the tool is now open again. The ram continues to withdraw to upper dead center in position I. In the position shown in FIG. 8*f*, precision-blanked workpiece 1' is carried off by means of rod grippers 10, and the scrap 49 is pushed away by swivel arms 48 of rod grippers 10.

In the graph of FIG. 9, curves representing the movements of ram 52 of transfer press 20 and of the individual pistons 21 to 24 of the precision blanking tool mounted in the transfer press are plotted and harmonized with one another. The pressing force produced by pistons 21–24 represents up to 75%, and the opposing force up to 30%, of the cutting force exerted by the ram. The shape and form of the workpiece determine the course of movement of the ram and of the individual pistons of the hydraulic cylinders, as well as the number of necessary functions and hence of cylinders.

The precision blanking tool illustrated in FIG. 3 includes upper and lower fixing plates 54 and 55, respectively, in addition to cover plate 8 and base plate 9. These fixing plates, situated about halfway up upper block 42 and cutting plate 41, serve to fix the precision blanking tool to a precision blanking press. For this purpose, recesses 60 are made in ram 52 and in table 53, in which recesses cover plate 8 with hydraulic unit 4, on the one hand, and base plate 9 with hydraulic unit 4', on the other hand, are accommodated. The precision blanking tool is used here on the precision blanking press for testing (see FIG. 4).

In the transfer press with built-in precision blanking tool, the sheet metal part is produced with individual tools in individual stages of operation, each stroke of the ram yielding one finished part. In the embodiment described, the ram of the transfer press moves downward, the table being fixed. The precision blanking tool described can be optimally designed as a single tool. The individual tools may be made independently of one another. The blanking die can be optimized and put in operation as the last tool. Each tool can be tested and optimized separately as a single tool, a normal precision blanking machine or a one-stage press being utilized. After optimization, all tools are assembled on common upper and lower mounting plates (see FIG. 1) and equipped with a set of rod grippers. If any tool drops out, only that tool need be dismantled and readjusted. The hydraulic system is supplied from a separate plant; the switching pulses for control come from the ram command.

What is claimed is:

1. A press for machining of sheet-metal workpieces or of cast or forged blanks, comprising:

a fixed table and a ram arranged for effecting stroke movements with respect to said table;

a set of stations arranged relative to said table and said ram;

one of said stations including a fine-blanking tool assembly;

said tool assembly including a first tool support associated with said ram, a plurality of first tool parts associated with said first tool support;

said tool assembly including a second tool support associated with said table, a plurality of second tool parts associated with said second tool support;

said first tool support including a plurality of first hydraulic units;

said second tool support including a plurality of second hydraulic units;

each of said first and second hydraulic units of said first and second tool supports including a cylinder, a piston capable of reciprocal movements relative to its associated cylinder, and means for transmitting movements from each said piston to an associated one of said first and second tool parts; and a control device for said first and second hydraulic units of said first and second tool supports, said control device including means for independently and selectively driving the pistons within their associated cylinders during a course of a stroke movement of said ram to effect a plurality of fine-blanking operations within said tool assembly during said stroke movement.

2. A press according to claim 1, wherein said first hydraulic units of said first tool support include first and second cylinders with an associated one of said pistons within each of said first and second cylinders, and said second hydraulic units of said second tool support include third and fourth cylinders with an associated one of said pistons within each of said third and fourth cylinders.

3. A fine-blanking tool assembly for mounting in a press having a fixed table and an associated movable ram to effect a plurality of fine-blanking operations on a sheet-metal workpiece or a cast or forged blank during a stroke movement of said ram with respect to said table, said tool assembly comprising:

a first tool support integral with one of said ram and table, a plurality of first tool parts associated with said first tool support;

a second tool support integral with the other one of said ram and table, a plurality of second tool parts associated with said second tool support;

first hydraulic units associated with said first tool support;

second hydraulic units associated with said second tool support;

each of said first and second hydraulic units including a cylinder integral with an associated one of said first and second tool supports, a piston capable of reciprocal movements within its associated cylinder, and transmission means for transmitting movements from each said piston to an associated one of said first and second tool parts; and a control device including driving means for independently and selectively driving said pistons within their associated cylinders during a course of said stroke movement of said ram.

4. A tool assembly according to claim 3, wherein said first hydraulic units of said first tool support include first and second cylinders with an associated one of said pistons within each of said first and second cylinders, and said second hydraulic units of said second tool support include third and fourth cylinders with an associated one of said pistons within each of said third and fourth cylinders.

5. A tool assembly according to claim 3, wherein adjusting means are provided on both of said first and second tool supports for independently adjusting said first and second tool parts with respect to said first and second tool supports, said adjusting means and said driving means being respectively adjusted and controlled so that at least two fine cutting operations are performed, during said stroke movement of said ram, on portions of said workpiece or blank when said portions are disposed at different levels to each other.

6. A tool assembly according to claim 3, wherein said transmission means includes at least a first and second thrust bolt, said first thrust bolt rigidly connecting a selected one of said first tool parts to an associated one of said pistons, said second thrust bolt rigidly connecting a corresponding one of said second tool parts to a corresponding associated one of said pistons with one of the selected first tool part and corresponding second tool part acting as a holding punch, and with the other one of the selected first tool part and corresponding second tool part acting as a holding counterpunch during said stroke movement, a selected portion of said workpiece or blank being pinched between said punch and counterpunch during at least a part of said stroke movement with said workpiece or blank moving with respect to said ram and with respect to said table, and other portions of said workpiece or blank being blanked between other associated ones of said first and second tool parts during said part of said stroke movement.

7. A tool assembly according to claim 3, including means for performing two fine-blanking operations on portions of said workpiece or blank lying respectively at different levels to each other, comprising:

at least a first one of said first tool parts being integrally connected to said first tool support;

a corresponding first one of said second tool parts being integrally connected to said transmission means to rigidly connect said first one of said second tool parts to a corresponding first one of said pistons, said first one of said pistons being part of a first one of said second hydraulic units of said second tool support;

a second one of said second hydraulic units of said second tool support including a second one of said pistons, said second one of said pistons being rigidly connected to a second one of said second tool parts;

said second one of said second tool parts being adjusted to cooperate with a second one of said first tool parts, said second one of said first tool parts being rigidly connected to a third one of said pistons, said third one of said pistons being part of a first one of said first hydraulic units of said first tool support;

said first and second tool parts and driving means being adjustable for enabling said two fine-blanking operations to be performed during said stroke movement of said ram with each of said operations being at a different level to each other; and means for adjusting said different level of each of said operations.

* * * * *